United States Patent [19]

Friedrichs

[11] Patent Number: 4,995,172

[45] Date of Patent: Feb. 26, 1991

[54] METHOD FOR HIGH-FREQUENCY DRYING OF COMBUSTIBLE GOODS AND, WITH FIRE SUPPRESSION

[75] Inventor: Kurt Friedrichs, Muckelhoven, Fed. Rep. of Germany

[73] Assignee: H. Krantz GmbH & Co., Fed. Rep. of Germany

[21] Appl. No.: 504,412

[22] Filed: Nov. 24, 1989

Related U.S. Application Data

[62] Division of Ser. No. 323,805, Mar. 15, 1989, Pat. No. 4,896,433.

[51] Int. Cl.[5] ..... F26B 3/34

[52] U.S. Cl. ..... 34/1; 34/46; 34/52; 68/209

[58] Field of Search ..... 34/1, 4, 39, 45, 49, 34/46, 52; 68/13 R, 209

[56] References Cited

U.S. PATENT DOCUMENTS 2,698,488 1/1955 Cannon et al. ..... 34/46 X 4,501,072 2/1985 Jacoki, Jr. et al. ..... 34/1

*Primary Examiner*—Albert J. Makay
*Assistant Examiner*—John Sollecito
*Attorney, Agent, or Firm*—Mark T. Basseches

[57] ABSTRACT

In the regions of a drying zone within a tunnel (2) exposed to fire danger a sample of the air streams is drawn off via an intake pipe (11) disposed transversely to the longitudinal extent of the tunnel. The sample is supplied to a measuring device which contains two regeneratable filters which are alternatingly acted upon by the sample via switch-over valves. The measuring device contains a sensor acted upon by the cleansed gas which sensor reacts to CO and is connected to an alarm system and or an extinguisher device. From the extinguisher device an extinguisher agent line (16) leads to an extinguisher pipe (14) which is likewise in the direction of flow of the air steam guided through the tunnel (2) arranged transversely to the longitudinal extent of the tunnel (2) and provided with extinguisher agent exit nozzles.

4 Claims, 2 Drawing Sheets

METHOD FOR HIGH-FREQUENCY DRYING OF COMBUSTIBLE GOODS AND, WITH FIRE SUPPRESSION

This application is a division of application Ser. No. 323,805 filed Mar. 15, 1989 now U.S. Pat. No. 4,896,433.

BACKGROUND OF THE DISCLOSURE

This invention relates to a method for the drying, in particular by high frequency electric fields, of combustible goods carried continuously through a drying zone. Extracted from the goods in the process is moisture which is evaporated. The moisture is carried off by an air stream guided through a drying zone.

The invention, furthermore, relates to a high-frequency dryer, in particular for rolls of textile goods, for carrying out the method. The dryer comprises a horizontally directed drying tunnel, a belt transporting the goods to be dried through the drying tunnel, electrodes disposed above and below the belt which generate a dielectric field, and a ventilator which maintains an air stream through the tunnel.

PRIOR ART

Such methods or arrangements are generally known and function, in particular for drying rolls of textile goods. Herein the drying result, apart from different system parameters, is inter alia a function of the input moisture of the rolls being transported through the tunnel. Since the input moisture content of the rolls cannot be precisely set to a given constant value, the dielectric constant by necessity changes. As a result electrical breakdowns cannot be completely excluded. These can lead to the situation that rolls individually or in groups are ignited.

SUMMARY OF THE INVENTION

The present invention is directed to a method and apparatus for promptly discovering the existence of a fire and controlling same.

The method according to the invention enables the use of a high-sensitivety reacting sensor, known per se, by which, for example, a fire or smoldering fire limited to only a few textile rolls could be immediately discovered. To this end, it is required that the sensor respond to a low CO concentration of a few ppm. Since, however, the air stream is laden with the evaporating moisture of the goods to be dried as well as residual chemical material from a pre- or post-treatment of the goods, a direct action of a sensitive sensor with a part of the air stream is impossible. It is only after the sample of the air stream is cleansed of foreign components in the manner taught by the invention, that a highly sensitive sensing device may be used since false readings would otherwise result. Also, without this pre-cleansing the corrosiveness of the air stream enriched with different chemicals would within a short period of time destroy the sensor and even before its destruction render it completely useless for the reliable indication of a low CO concentration.

According to an implementation of the method of the invention the sample to be cleansed is guided through a first filter to the sensor, ideally until this has reached load capacity. Through an automatic switch-over subsequent samples are guided though a second filter to the sensor ideally until this has reached its load capacity. The two filters are connected to a regenerating apparatus, known per se, such that the one filter has become regenerated before the other is filled.

Through this procedural manner the sample can be guided through a functional filter without the operation needing to be interrupted for the purpose of changing filters. The load capacity and regeneratability of the two filters are so adjusted to each other that the time interval for loading is longer than the time interval required for the filter regeneration. It is of course within the scope of the invention to use also more than two filters and to change the time ratio of loading/regeneration correspondingly.

Upon sensing concentrations of CO exceeding a predetermined threshold the sensor may activate a fire control system such as an alarm, halon injection, etc. As an extinguishing agent halon is preferably used by inserting it transversely into the air stream at the entrance of the stream. It can be shown by experiment that halon, in the presence of high-frequency irradiation, is particularly effective as an extinguishing agent.

In order to displace the source of the fire out of the drying zone an implementation of the method according to the invention provides that the sensor acted upon by a predetermined CO value of the sample, accelerates the drive for the rapid transport of the goods clear of the drying zone.

BRIEF DESCRIPTION OF THE DRAWINGS

In the drawings an example of a high-frequency dryer for carrying out the method according to the invention is shown schematically.

Therein

Figure 1:
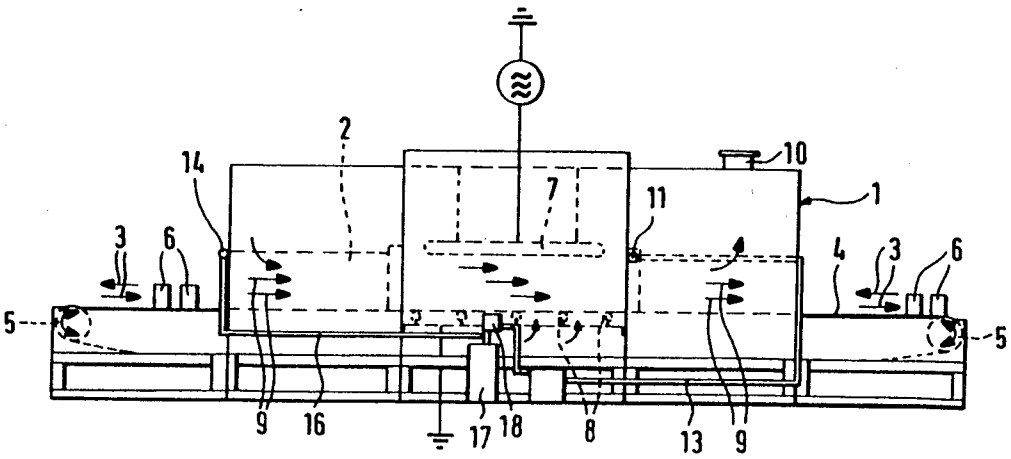
FIG. 1 shows the dryer in lateral view.

The high-frequency dryer comprises essentially the drying tunnel 2 surrounded by a housing 1, through which transport belt 4 moves sequentially in alternate directions as shown by the arrows 3. An upper section of the transport belt 4 runs inside of the drying tunnel 2 a lower section guided by drums 5 running below the tunnel. The transport belt 4 is continuously loaded and unloaded with yarn rolls 6 before each entrance into and after each exit from the drying tunnel 2.

Within the drying tunnel 2 above the plane of movement of the particular section of the transport belt 4 a heightadjustable electrode 7 is disposed. Opposite this, however below the plane of movement of the particular section of the transport belt 4, a stray field electrode 8 is arranged. The electrodes 7 and 8 generate a dielectric field wherewith moisture is driven out of the yarn rolls 6 in a manner known per se.

By means of a ventilator (not shown) an air stream is maintained within the drying tunnel 2 in the direction of the arrows 9 independently of the direction of movement of the transport belt 4, the moisture being carried off through an exhaust air fitting 10.

In the air stream downstream of the electrode 7 an intake pipe 11 is disposed extending transversely over the transport belt 4, the pipe being provided with inlet openings 12 uniformly distributed over its length. The intake pipe 11 is connected via a line 13 with a diaphragm pump (not shown) arranged outside the drying tunnel.

In the region of the entrance of the drying tunnel 2 defined by the direction of air flow an extinguisher pipe 14 extending likewise transversely over the transport belt 4 is arranged, the pipe 14 being provided with outlet openings 15 distributed uniformly over its length. The extinguisher agent is connected via an extinguisher agent line 16 with an extinguisher agent container 17, having triggering device 18 arranged outside of the drying tunnel 2.

Figure 2:
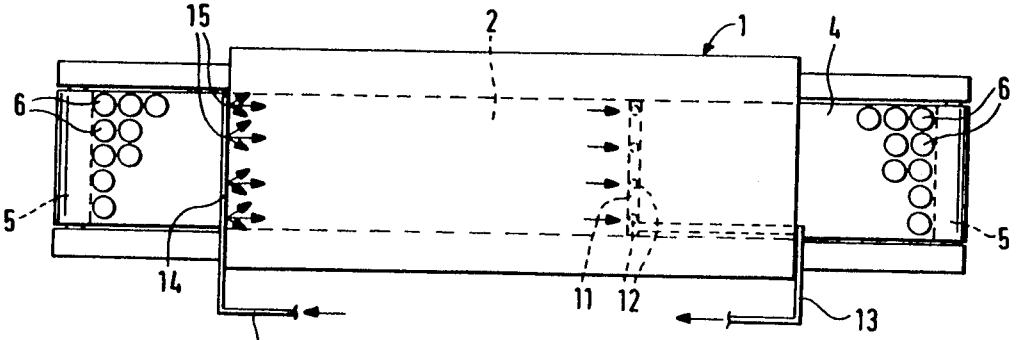
FIG. 2 a plan view of the dryer.
Figure 3:
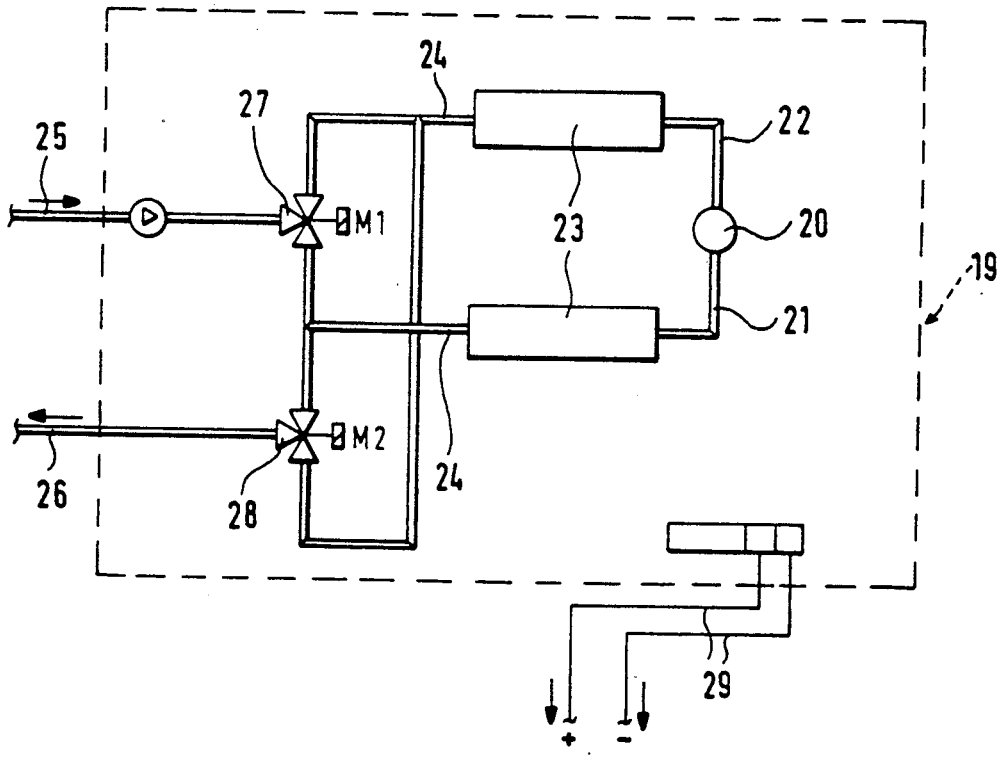
FIG. 3 the CO measuring system as a block diagram.

The trigger device 18 is activated via a CO measuring system 19 (FIG. 3). System 19 contains for this purpose a sensor 20 reacting to CO which sensor via a line 21 or 22 is continuously acted upon by a gas sample. The gas sample is previously optionally cleansed with one of two regeneratable filters 23. The filters 23 are connected via feed or outlet lines 24 to a gas feed line 25 or gas outlet line 26, with the gas feed line 25 being connected to line 13 (FIGS. 1,2). To line 25 a gas inlet valve 27 is connected and to line 26 a gas outlet valve 28. These are implemented as three-way valves and permit thus, depending on the control position that the one or the other filter 23 is acted upon by gas from the tunnel.

The filter 23 may include actuable regenerating means, known per se, whereby the filter or filters unconnected to the sensor 20 is being regenerated as the other filter or filters are being loaded.

When the sensor 20 detects excess CO concentrations the trigger device 19 and/or additionally a (not shown) acoustic or optical alarm system or belt accelerator can be activated via appropriate electrical lines 29.

As will be evident from the foregoing, there is described herein a novel method and apparatus for continuously monitoring a drying device to detect and extinguish fires. Numerous variations of the embodiment described will occur to the skilled worker familiarized with the instant disclosure which is accordingly to be broadly construed within the scope of the appended claims.

I claim:

1. A method of drying combustible goods by a high-frequency electric field wherein said goods are continuously advanced through a drying tunnel wherein moisture is extracted and then carried off by an air stream traversing said tunnel, the improvement which comprises extracting an increment of said air stream, passing said extracted increment through filter means to remove impurities other than CO from said increment, subjecting said filtered increment to a sensor adapted to evaluate CO content of said filtered increment and activating a fire control system responsive to concentrations of CO sensed by said sensor in excess of a predetermined concentration.

2. The method in accordance with claim 1 wherein said step of passing said increment through said filter means includes providing first and second filters passing said increment through a first said filter for a predetermined period and thereafter passing said increment through said second filter while simultaneously purging said first filter.

3. The method of claim 2 and including the step of accelerating the speed of advance of said goods through said tunnel responsive to the detection by said sensor of CO concentrations exceeding said predetermined concentration.

4. The method in accordance with claim 2 wherein said fire control system comprises injecting halon gas into said tunnel.

* * * * *